US010689788B2

(12) United States Patent
Harbrecht et al.

(10) Patent No.: US 10,689,788 B2
(45) **Date of Patent: *Jun. 23, 2020**

(54) LAUNDRY TREATING APPLIANCE DOOR ASSEMBLY COMPRISING A PLASTIC FISHBOWL

(71) Applicant: WHIRLPOOL CORPORATION, Benton Harbor, MI (US)

(72) Inventors: Ethan Harbrecht, Michigan City, IN (US); Douglas Mikkelsen, Saint Joseph, MI (US); Christoph Miller, Saint Joseph, MI (US); Joel Sells, Watervliet, MI (US); Prasath M. Thirukonda, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/583,395

(22) Filed: Sep. 26, 2019

(65) Prior Publication Data

US 2020/0018009 A1 Jan. 16, 2020

Related U.S. Application Data

(63) Continuation of application No. 16/391,647, filed on Apr. 23, 2019, now Pat. No. 10,472,759, which is a (Continued)

(51) Int. Cl.
*B60J 5/04* (2006.01)
*D06F 37/28* (2006.01)
(Continued)

(52) U.S. Cl.
CPC ..... *D06F 37/28* (2013.01); *D06F 34/28* (2020.02); *D06F 39/008* (2013.01); *D06F 39/04* (2013.01); *D06F 39/085* (2013.01); *D06F 39/14* (2013.01)

(58) Field of Classification Search
CPC ..... D06F 37/28; D06F 39/14; D06F 39/008; D06F 39/02; D06F 39/00
(Continued)

(56) References Cited

U.S. PATENT DOCUMENTS 4,987,627 A 1/1991 Cur et al.
6,761,049 B2 7/2004 Nitschmann et al.
(Continued)

FOREIGN PATENT DOCUMENTS

DE 102009044711 B3 4/2011
EP 2302127 A1 3/2011
(Continued)

OTHER PUBLICATIONS

European Search Report for Counterpart EP17183417.9, dated Jan. 25, 2018.

*Primary Examiner* — Chi Q Nguyen
(74) *Attorney, Agent, or Firm* — McGarry Bair PC

(57) ABSTRACT

A laundry treating appliance door assembly comprises a plastic fishbowl. Typically, laundry treating appliances, such as dryers, have door assemblies comprising glass fishbowls. Utilizing plastic enables a fishbowl to have a sharper radius of curvature than that of a glass fishbowl due to manufacturing constraints of glass. A shaper radius of curvature allows for greater capacity in the treating chamber in a laundry treating appliance.

16 Claims, 9 Drawing Sheets

Related U.S. Application Data continuation of application No. 16/161,813, filed on Oct. 16, 2018, now Pat. No. 10,329,704, which is a continuation of application No. 15/255,213, filed on Sep. 2, 2016, now Pat. No. 10,132,021.

(51) Int. Cl.

| | |
|---|---|
| ***D06F 39/14*** | (2006.01) |
| ***D06F 34/28*** | (2020.01) |
| ***D06F 39/00*** | (2020.01) |
| ***D06F 39/04*** | (2006.01) |
| ***D06F 39/08*** | (2006.01) |

(58) Field of Classification Search

USPC ..... 49/502, 503; 34/603; 68/5 C, 5 D; 8/137

See application file for complete search history.

(56) References Cited

U.S. PATENT DOCUMENTS

| | | | |
|---|---|---|---|
| 7,614,162 | B2 | 11/2009 | Renzo |
| 7,934,404 | B2 | 5/2011 | Ha |
| D681,890 | S | 5/2013 | Anderson et al. |
| 8,631,527 | B2 | 1/2014 | Ashrafzadeh et al. |
| 8,875,416 | B2 | 11/2014 | Anderson et al. |
| 9,115,461 | B2 | 8/2015 | Anderson et al. |
| 9,732,459 | B2 | 8/2017 | Kim et al. |
| 10,053,811 | B2 | 8/2018 | Kim et al. |
| 10,132,021 | B2 | 11/2018 | Harbrecht et al. |
| 10,329,704 | B2 * | 6/2019 | Harbrecht ..... D06F 39/085 |
| 10,472,759 | B2 * | 10/2019 | Harbrech ..... D06F 37/28 |
| 2009/0064593 | A1 | 3/2009 | Ha |
| 2009/0120140 | A1 | 5/2009 | Choi et al. |
| 2011/0025177 | A1 | 2/2011 | Schone |
| 2011/0083476 | A1 | 4/2011 | Yang |
| 2013/0076220 | A1 | 3/2013 | Yeom et al. |
| 2013/0160501 | A1 | 6/2013 | Anderson et al. |
| 2014/0009049 | A1 | 1/2014 | Sung et al. |
| 2014/0157676 | A1 | 6/2014 | Kim |
| 2014/0319983 | A1 | 10/2014 | Park et al. |
| 2014/0325766 | A1 | 11/2014 | Roetker |
| 2015/0000200 | A1 | 1/2015 | Kim et al. |
| 2015/0067969 | A1 | 3/2015 | Boylston |
| 2015/0211166 | A1 | 7/2015 | Roetker |
| 2015/0267340 | A1 | 9/2015 | Malheiros |
| 2016/0201248 | A1 | 7/2016 | Kim et al. |

FOREIGN PATENT DOCUMENTS

| | | | |
|---|---|---|---|
| EP | 2596160 | B1 | 1/2016 |
| EP | 3034677 | A1 | 6/2016 |
| KR | 20040011827 | A | 2/2004 |
| WO | 2011154445 | A2 | 12/2011 |

* cited by examiner

LAUNDRY TREATING APPLIANCE DOOR ASSEMBLY COMPRISING A PLASTIC FISHBOWL

CROSS-REFERENCE TO RELATED APPLICATIONS

This application is a continuation of U.S. patent application Ser. No. 16/391,647, filed Apr. 23, 2019, now U.S. Pat. No. 10,472,759, issued Nov. 12, 2019, which is a continuation of U.S. patent application Ser. No. 16/161,813, filed Oct. 16, 2018, now U.S. Pat. No. 10,329,704, issued Jun. 25, 2019, which is a continuation of U.S. patent application Ser. No. 15/255,213, filed Sep. 2, 2016, now U.S. Pat. No. 10,132,021, issued Nov. 20, 2018, all of which are incorporated herein by reference in its entirety.

BACKGROUND

Laundry treating appliances, such as front-loading, horizontal axis clothes washers, typically have doors for accessing the treating chamber at least partially formed by a rotating drum. Such doors may include a cast glass window to enable observation of a laundry load as the appliance is operated. In order to maintain the moving laundry load away from the door and within the treating chamber, the window may be cast from glass with a convex or "bubble" shape, called a fishbowl, extending away from the inner face of the door and somewhat into the treating chamber when the door is closed.

The thick, cast glass of a fishbowl is typically expensive to manufacture, heavy, and occupies a substantial portion of the treating chamber that could otherwise be used for treating laundry. Glass used for a fishbowl is manufactured at a thickness of greater than 6 mm to prevent damage such as cracking. A fishbowl can comprise a radius of curvature that is defined by an intersection of an inner wall and a peripheral wall. Furthermore, the sharper the radius of curvature of a fishbowl, the greater capacity of the treating chamber. Due to the manufacturing constraints of casting glass, the minimum radius of curvature is usually only 210 mm.

SUMMARY

In one aspect, the disclosure relates to a fishbowl for a door assembly of a laundry treating appliance, the fishbowl including a peripheral wall defining an annulus with a central axis; and an inner wall located within the peripheral wall to close the annulus, and defining a surface that intersects with the peripheral wall, with the surface having a vertical portion and an angled portion.

Another aspect of the disclosure relates to a door assembly for a laundry treating appliance that includes a frame defining an opening, a window closing the opening, and a plastic fishbowl adjacent the window, where the plastic fishbowl includes a peripheral wall defining an annulus with a central axis, and an inner wall located within the peripheral wall to close the annulus and defining a surface that intersects with the peripheral wall, with the surface having a vertical portion and an angled portion.

Yet another aspect of the disclosure relates to a door assembly for a laundry treating appliance including a frame defining an opening and a plastic fishbowl closing the opening, where the plastic fishbowl includes a peripheral wall defining an annulus with a central axis, and an inner wall located within the peripheral wall to close the annulus and defining a surface that intersects with the peripheral wall, with the surface having a vertical portion and an angled portion.

DESCRIPTION OF EMBODIMENTS OF THE INVENTION

Figure 1:
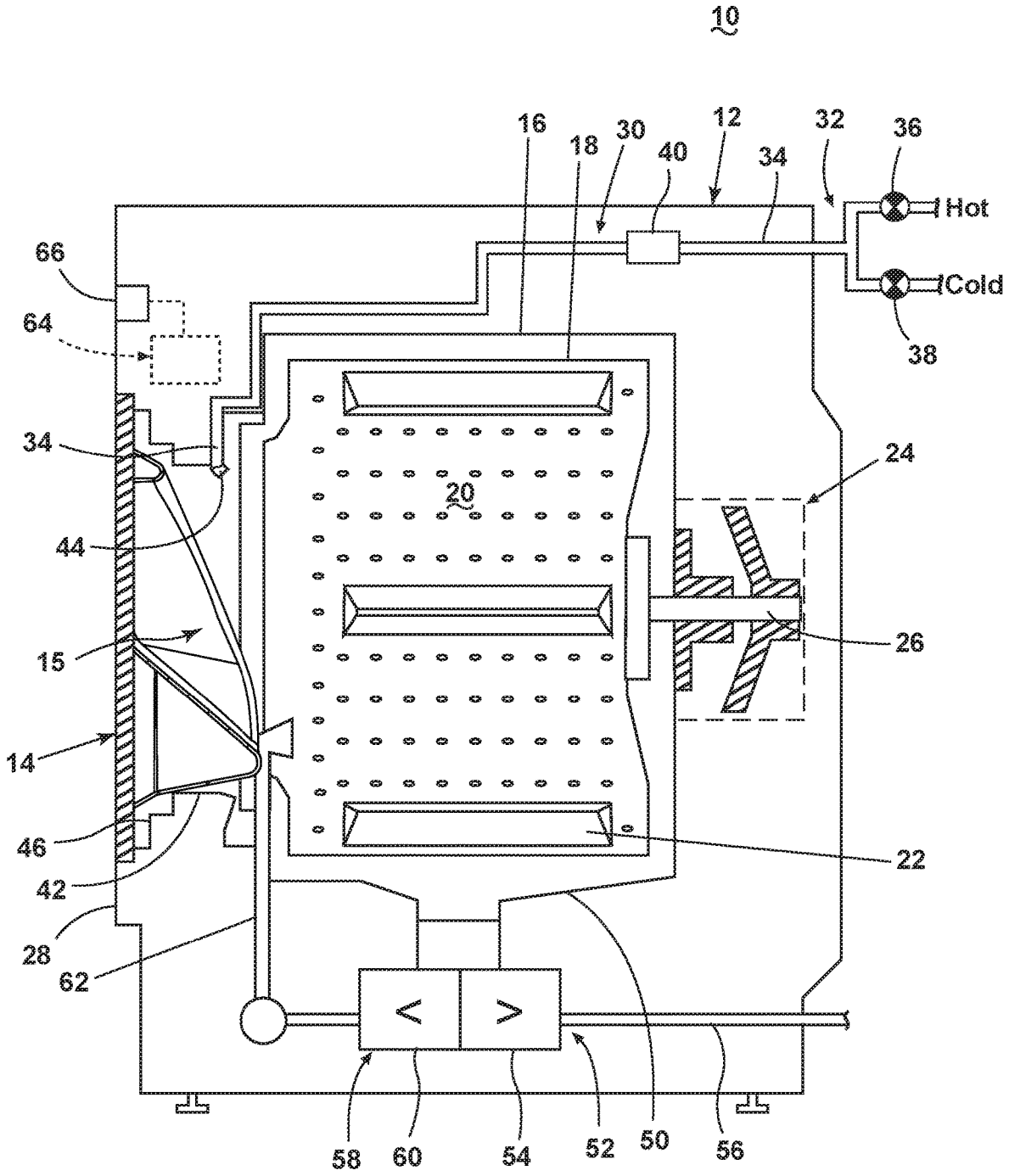
FIG. 1 is a schematic view of a laundry treating appliance in the form of a clothes washer according to an aspect of the innovation.

FIG. 1 is a schematic view of a laundry treating appliance in the form of a clothes washer 10 according to an embodiment of the invention. While the laundry treating appliance is illustrated as a horizontal axis clothes washer 10, the laundry treating appliance according to the invention may be any appliance which performs a cycle of operation on laundry, non-limiting examples of which include a vertical axis clothes washer, a combination washing machine and dryer, a tumbling or stationary refreshing/revitalizing machine, an extractor, a non-aqueous washing apparatus, and a revitalizing machine. The clothes washer 10 described herein shares many features of a traditional automatic clothes washer, which will not be described in detail except as necessary for a complete understanding of the invention. Although much of the remainder of this application will focus on the embodiment of an automatic clothes washer 10, the invention may have utility in other environments, including other cleaning appliances.

The clothes washer 10 may include a cabinet 12, which may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

A door 14 may be mounted to the cabinet 12 to selectively close an access opening to the interior of a liquid-holding, imperforate tub 16. The door 14 may be provided with a fishbowl 15, as hereinafter described in greater detail, and as described in U.S. Pat. No. 9,115,461, entitled "Door Wash Aid Dispenser for a Laundry Treating Appliance," which is fully incorporated by reference herein. The tub 16 may be supported within the cabinet 12 by a suitable suspension system (not shown). A drum 18 may be provided within the tub 16 and may have an inner periphery at least partially defining a treating chamber 20 with an open face for receiving fabric, such as laundry to be treated according to a cycle of operation. The drum 18 may be mounted for rotation within the tub 16 and may have perforations that permit the flow of liquid between the drum 18 and the tub 16.

The tub 16 and drum 18 may have aligned openings, which provide access to the treating chamber 20. The door 14 may be provided to selectively close at least one of the aligned openings to selectively provide access to the treating chamber 20 through the open face of the treating chamber 20. While the illustrated clothes washer 10 includes both the tub 16 and the drum 18, with the drum 18 defining the treating chamber 20, it is within the scope of the invention for the clothes washer 10 to include only one receptacle, with the receptacle defining the treating chamber 20 for receiving the laundry load to be treated.

At least one lifter 22 may be provided in the drum 18 to facilitate movement of the laundry load within the drum 18 as the drum 18 rotates. The lifter 22 may be provided on the inner periphery of the drum 18. Multiple lifters 22 may be provided and may optionally be evenly spaced about the inner periphery of the drum 18.

The drum 18 may be coupled with a motor 24 through a drive shaft 26 for selective rotation of the drum 18 during a cycle of operation. It may also be within the scope of the invention for the motor 24 to be coupled with the drive shaft 26 through a drive belt for selective rotation of the drum 18. The motor 24 may rotate the drum 18 at multiple or variable speeds and in one direction or opposite rotational directions.

A liquid supply system 30 may also be included in the clothes washer 10 to supply liquid to the treating chamber 20. More specifically, liquid, such as water, may be supplied from a liquid source 32, such as a household water supply, to the clothes washer 10 by operation of at least one control valve controlling the flow of water through a supply or inlet conduit 34. As shown herein, separate valves 36, 38 may control the supply of hot and cold water, respectively, through the inlet conduit 34. A flow meter 40 may be positioned in the inlet conduit 34 and may have any suitable output representative of the flow of water through it. The inlet conduit 34 may direct the water from the liquid source 32 to the treating chamber 20, and as an example, the inlet conduit 34 may direct the water into the drum 18. As shown, the inlet conduit 34 may be coupled with a bellows 42.

The bellows 42 may couple the open face of the tub 16 with a front wall 28 of the cabinet 12, and the door 14 may seal against the bellows 42 when the door 14 closes against the cabinet 12. The bellows 42 may be configured with a compliance portion 46, which is illustrated as a fold that may deform to facilitate relative movement of the tub 16 and the front wall 28, and sealing of the closed door 14 against the bellows 42. The open face of the treating chamber 20 may coincide with an open face defined by the bellows 42 where the bellows 42 meets the cabinet 12.

The inlet conduit 34 may comprise a liquid dispenser in the form of a supply nozzle 44, for example, configured to supply the water into the treating chamber 20 along a flow path in a desired pattern and under a predetermined amount of pressure. For example, the supply nozzle 44 may be configured to supply a stream of water into the treating chamber 20 by gravity, i.e., a non-pressurized stream. The supply nozzle 44 may be mounted to the bellows 42 and be located in any desired position around the open face of the treating chamber 20. As an example, the supply nozzle 44 may be located at an uppermost position of the treating chamber 20, which would correspond to about the 12 o'clock position on the drum 18, to supply the liquid in a flow path generally downward toward the lowermost position of the treating chamber 20, which would correspond to about the 6 o'clock position on the drum 18.

Liquid in the treating chamber 20 may flow by gravity to a low portion or sump 50 of the tub 16. A liquid drain system 52 may be provided for draining liquid from the treating chamber 20. The liquid drain system 52 may include a drain pump 54 and a drain conduit 56. The drain pump 54 fluidly couples the sump 50 to the drain conduit 56 such that liquid in the tub 16 may be drained via the drain conduit 56. The drain conduit 56 may be coupled with a household drain.

An optional liquid recirculation system 58 may be provided for recirculating liquid to the treating chamber 20. As illustrated, the recirculation system 58 includes a recirculation pump 60 and a spray conduit 62. The recirculation pump 60 may fluidly couple the tub 16 to the spray conduit 62 such that liquid in the tub 16 may be supplied to the spray conduit 62, where it may be sprayed into the treating chamber 20. The recirculation pump 60 may be fluidly coupled to the sump 50 of the tub 16. The spray conduit 62 may direct the liquid from the recirculation pump 60 into the drum 18 in any suitable manner, such as by spraying, dripping, or providing a steady flow of the liquid. While the clothes washer 10 is illustrated as having separate drain and recirculation pumps 54, 60, in an alternative embodiment, the clothes washer 10 may include a single pump configured to selectively drain or recirculate liquid, such as by configuring the pump to rotate in opposite directions, or by providing a suitable valve system.

The clothes washer 10 may further include one or more devices for heating the liquid, such as a steam generator and/or a sump heater (not shown). The steam generator may be provided to supply steam to the treating chamber 20. The sump heater may be used to heat liquid in the sump 50. Alternatively, the sump heater may be used to heat laundry (not shown), air, the drum 18, or liquid in the tub 16 to generate steam, in place of or in addition to the steam generator. The steam generator may be used to heat the laundry as part of a cycle of operation, much in the same manner as a sump heater, as well as to introduce steam to treat the laundry.

A controller 64 may be located within the cabinet 12 for controlling the operation of the clothes washer to implement one or more cycles of operation, which may be stored in a memory of the controller 64. Examples, without limitation, of cycles of operation include: wash, heavy duty wash, delicate wash, quick wash, refresh, rinse only, and timed wash. A user interface 66 operably coupled to the controller 64 may also be included on the cabinet 12 and may include one or more knobs, switches, displays, and the like for communicating with the user, such as to receive input and provide output. The user may enter many different types of information, including, without limitation, cycle selection and cycle parameters, such as cycle options. During operation of the clothes washer 10, the controller 64 may be operably coupled with one or more components of the clothes washer 10 for communicating with and controlling the operation of the component to complete a cycle of operation. For example, the controller 64 may be operably coupled with at least the motor 24, the valves 36, 38, the flow meter 40, the drain pump 54, and the recirculation pump 60 to control the operation of these and other components to implement one or more of the cycles of operation.

Figure 2:
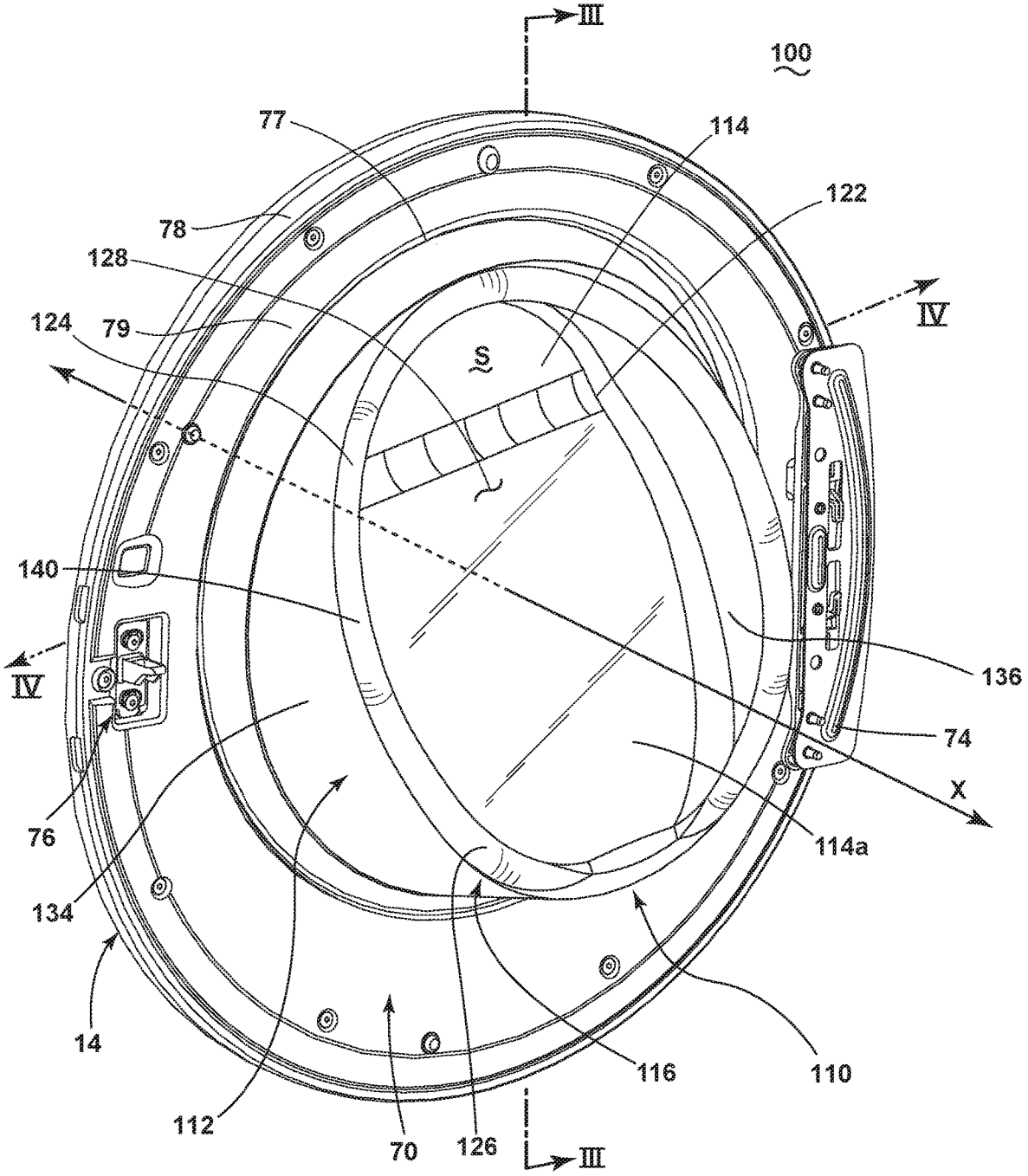
FIG. 2 is a rear perspective view of the door illustrated in FIG. 1.

Referring now to the rear perspective view of the door assembly 100 comprising a door 14 and adjoining fishbowl 110 in FIG. 2, the door 14 may include a frame 70 surrounding a window 72 that closes an opening 77. The frame 70 is illustrated in the present embodiment as generally circular to accommodate a corresponding structure (not shown) on the cabinet 12, but it may be understood that the frame 70 may be any suitable shape, such as elliptical, octagonal, or generally rectangular to cover most or all of the front of the cabinet 12. The frame 70 may be configured on one side with a hinge mount 74 that may receive a hinge assembly for movably mounting the door 14 to the cabinet 12, and may support a latch 76 on the opposite side for securing the door 14 to the cabinet 12 in the closed position.

Figure 3:
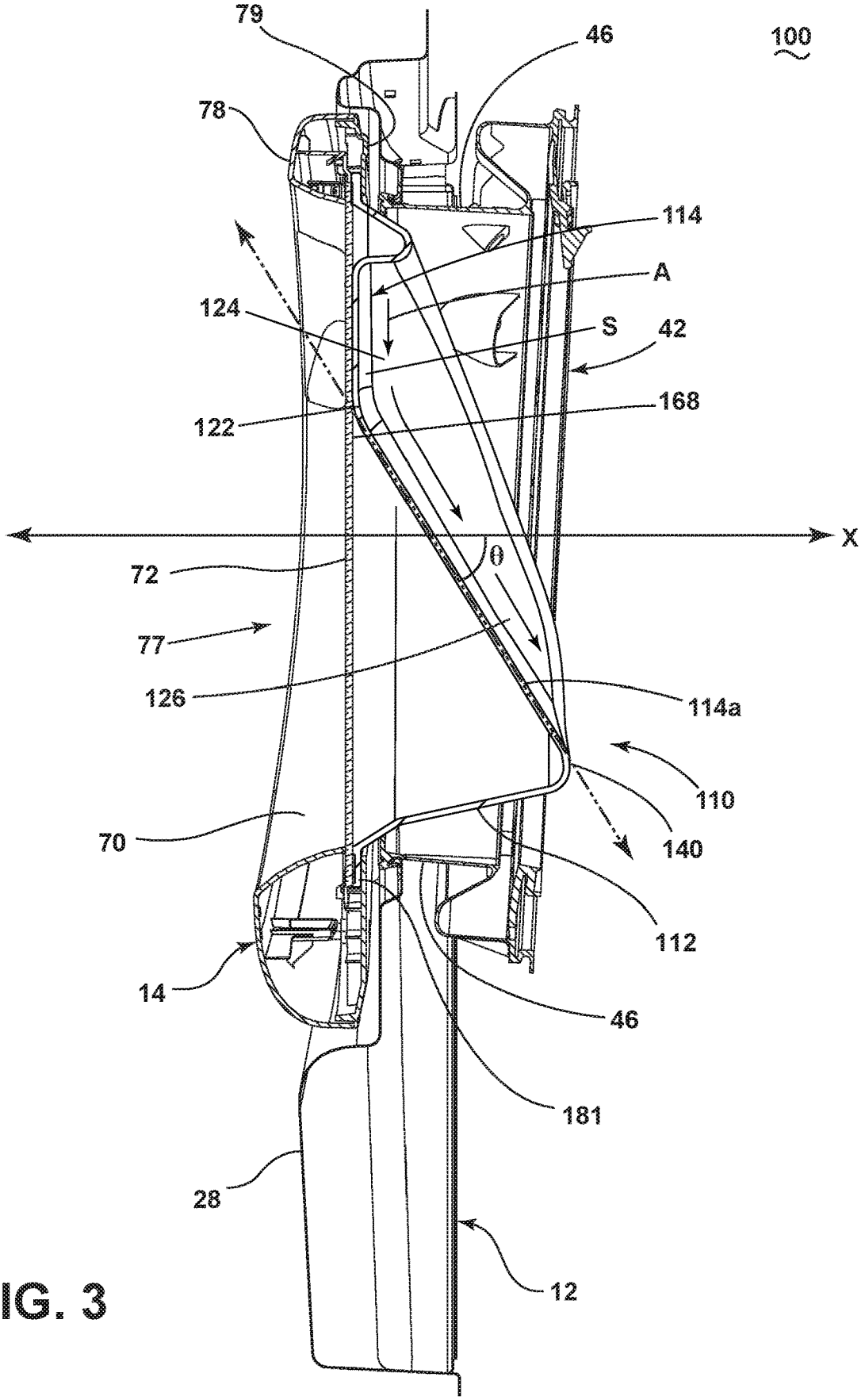
FIG. 3 is a cross-sectional view taken along view line of FIG. 2.

Referring to FIG. 3, the frame 70 may be a single element, or may be a composite including an outer trim element 78 and an inner trim element 79 joined together to form the frame 70. The trim elements 78, 79 may be permanently joined, such as by welding, adhesives, and the like, or joined to enable disassembly of the frame 70 by suitable removable fasteners, such as threaded fasteners, interference fit and press fit fasteners, and the like. The inner trim element 79 of the frame 70 defines the opening 77. The frame 70 may be provided with one or more handles (not shown), including recesses formed in the outer trim element 78 or exterior portion of the frame 70, for grasping by a user to open and close the door 14.

The window 72 may be generally flat or planar, and substantially translucent or transparent so that a user may view the interior of the treating chamber 20 when the door 14 is closed. In an alternative embodiment, the window 72 may be omitted or opaque. Further, the window 72 may be circular in shape, as illustrated for exemplary purposes, corresponding with the circular shape of the frame 70. Nevertheless, it is within the scope of the invention for the window 72 to have any suitable areal shape consistent with the shape of the door 14.

The fishbowl 110 is disposed on the window 72, and the fishbowl 110 can be substantially translucent or transparent to enable viewing through the window 72 and the fishbowl 110. The fishbowl 110 is made up of a plastic, and can be formed by injection molding. By providing a fishbowl 110 that is made of translucent or transparent plastic, the fishbowl 110 provides the aesthetic appeal of a glass fishbowl, but enables capacity-enhancing benefits described herein due to the versatility of plastic as compared to glass. The fishbowl 110 may be mounted to the window 72, the frame 70, to both the frame 70 and the window 72, or may be integrally formed with the frame 70 or with the window 72. The fishbowl 110 may be sized for receipt within the open face of the bellows 42, as will be discussed in more detail below.

Turning back to FIG. 2, the fishbowl 110 can include a generally annular or "ring-like" peripheral wall 112 and may be associated with a rear side of the door 14, i.e., the side of the door 14 that faces the treating chamber 20 when the door 14 is closed. The peripheral wall 112 forms an annulus 116, which may form a complete annulus, or a partial annulus defining, or bounding an interior 128. A central axis "X" is defined by the peripheral wall 112 wherein the central axis "X" projects through the center of the peripheral wall 112, and in exemplary implementations is parallel to the surface on which the clothes washer 10 rests.

The peripheral wall 112 comprises a dual-wall structure with a first wall 134 and a second wall 136. The junction at which the first wall 134 and second wall 136 intersect forms an apex 140 of the peripheral wall 112, which is curved or rounded. The depth from the frame 70 to the apex 140 of the peripheral wall varies. An upper portion 124 of the peripheral wall 112 tends have less depth than the lower portion 126 of the peripheral wall 112. Reduction of the area of the second wall 136 causes more efficiency in keeping laundry, such as socks, from resting on the second wall 136 and creating a build-up of laundry.

An inner wall 114 is disposed within the peripheral wall 112 and comprises a downwardly sloping section 114*a* and a surface "S". The downwardly sloping section 114*a* may function to direct liquid and laundry items moving along the interior 128 of the fishbowl 110 toward the treating chamber 20. The surface "S" of the inner wall 114 intersects the peripheral wall 112 at intersection 122.

Figure 4:
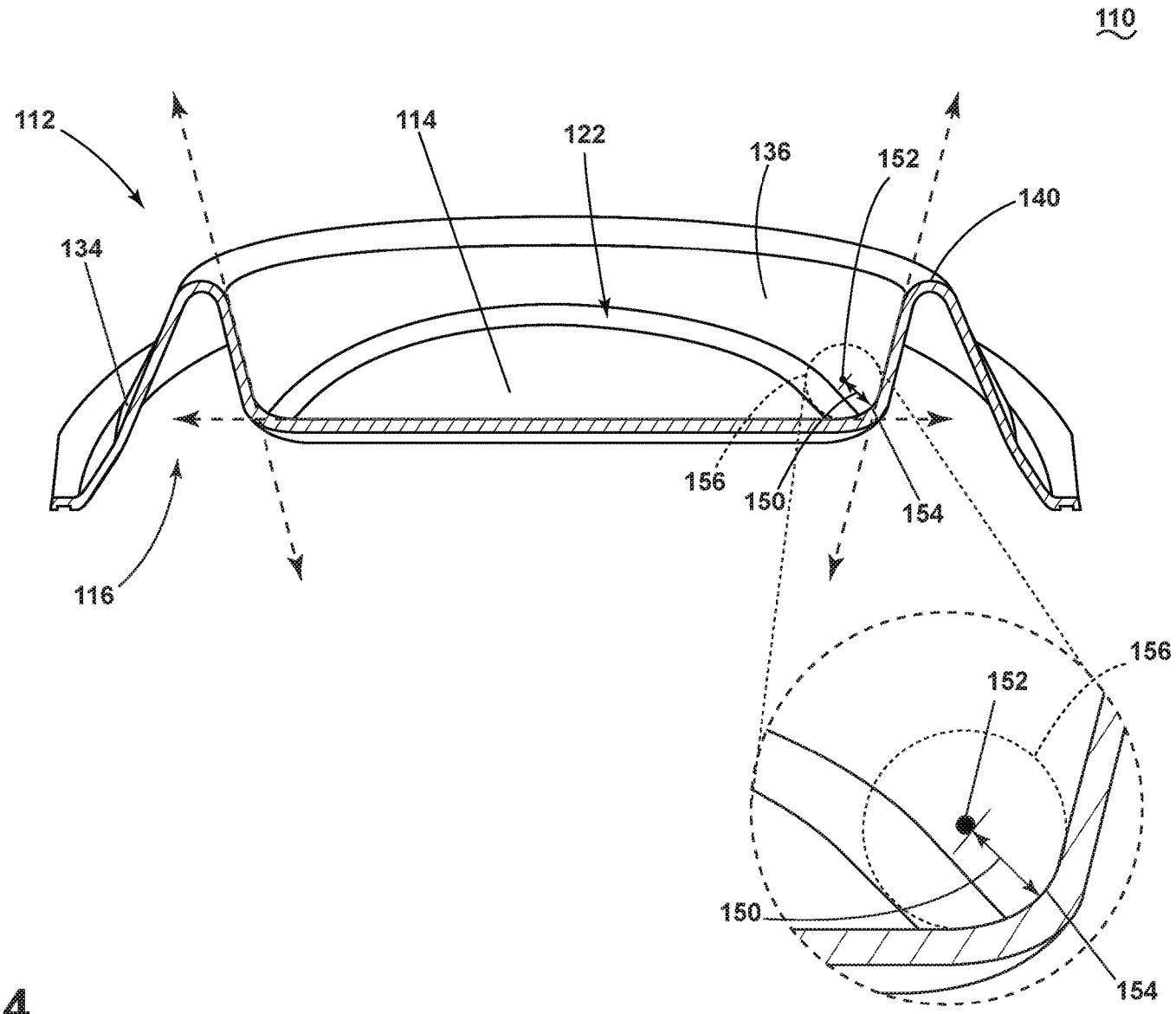
FIG. 4 is a cross-sectional view taken along view line IV-IV of FIG. 2

The intersection 122 defines a radius having a radius of curvature 150, illustrated in FIG. 4. Virtual extensions of the inner wall 114 and the second wall 136 of the peripheral wall 112 are shown in dashed lines. A fillet 154 is disposed within the intersection 122 and can define at least a portion of a circle 156 or an arcuate surface, such that an effective radius of curvature 150 is defined between the fillet 154 and a center point 152 of the circle 156. The radius of curvature 150 can be less than 200 mm and as low as 138 mm. Decreasing the radius of curvature 150 increases the capacity of the treating chamber 20 by utilizing less material and thereby creating more space in the treating chamber 20. Without wishing to be bound by theory, the reduced radius of curvature 150 for a fishbowl 110 can be correlated to the ability to manufacture plastic for a fishbowl 110 at a thickness of 4 mm, while glass is only able to be manufactured to a thickness greater than 6 mm.

As best seen in FIG. 3, the cross-sectional view taken along view line of FIG. 2, the frame 70 may have an outer trim element 78 and an inner trim element 79. The fishbowl 110 may have a generally circular perimeter flange 181, defining a planar rear face 168 that may enable the window 72 and the fishbowl 110 perimeter flange 181 to be "sandwiched" between the outer trim element 78 and the inner trim element 79 when joined together. The fishbowl 110 may be mounted between the outer trim element 78 and inner trim element 79 so that the planar rear face 168 is adjacent to and abuts the window 72. This may enable the window 72 and the fishbowl 110 to be readily replaced, as necessary, merely by separating the trim elements 78, 79. Alternatively, the inner trim element 79 and fishbowl 110 may be fabricated as a single element for coupling with the outer trim element 78. With this configuration, the window 72 may be "sandwiched" therebetween.

When the door 14 is closed, the fishbowl 110 may extend into the treating chamber 20 such that different parts of the fishbowl 110, such as the peripheral wall 112, may project different distances into the treating chamber 20, i.e. away from the window 72. In this configuration, the fishbowl 110 may overlie the compliance portion 46 of the bellows 42 and the rim of the drum 18. In order to enable movement and sealing, the compliance portion 46 may tend to deform in such a manner as to allow laundry items to enter around and behind the compliance portion 46. The extension of the fishbowl 110 over the compliance portion 46 and into the treating chamber 20 may prevent laundry items from becoming entrapped by the bellows 42 between the drum 18 and the door 14 or cabinet 12. Laundry items may travel downward along the inner wall 114 to the peripheral wall 112 and the downwardly sloping section 114*a*, and then slide over and past the bellows 42 into the treating chamber 20. The first wall 134 and second wall 136 of the peripheral wall 112 form a V-shaped cross-section at the apex 140.

The fishbowl 110 may also seal against the bellows 42 by the peripheral wall 112 abutting the bellows 42 around the circumference of the fishbowl 110. The seal between the fishbowl 110 and the bellows 42 may inhibit the laundry from migrating through the open face of the treating chamber 20, thereby retaining the laundry load in the treating chamber 20. It may also form a fluid seal to prevent leakage of treating fluid out of the clothes washer 10 between the door 14 and the cabinet 12.

An included angle θ is defined by the intersection of surface S of the downwardly sloping section 114*a* of the inner wall 114 relative to the central axis X. Extensions are shown in dashed lines along the surface S of the downwardly sloping section 114*a* of the inner wall 114 to better view the included angle θ relative to the central axis X. The included angle θ is generally greater than 30°. Using plastic to manufacture the fishbowl 110 enables the included angle θ to be as low as, or even lower than 30°. A glass fishbowl is typically only able to be manufactured to have a minimum included angle of 45°. Here, the included angle θ is about 56°. In exemplary implementations, the included angle θ is less than about 60°, less than about 50°, less than about 40°, or less than about 35°. Decreasing the included angle θ, increases the capacity of the treating chamber 20, therefore. Capacity of the treating chamber 20 is influenced because the included angle θ affects the slope of the downwardly sloping section 114*a*. Decreasing the included angle θ causes the location of the intersection 122 to move vertically downwards so that the inner wall 114 has more horizontal surface area. In other words, intersection 122 moves vertically downwards when the included angle θ is decreased, resulting in more capacity because more horizontal surface area of the inner wall 114 is exposed, creating more space in the drum.

Figure 5:
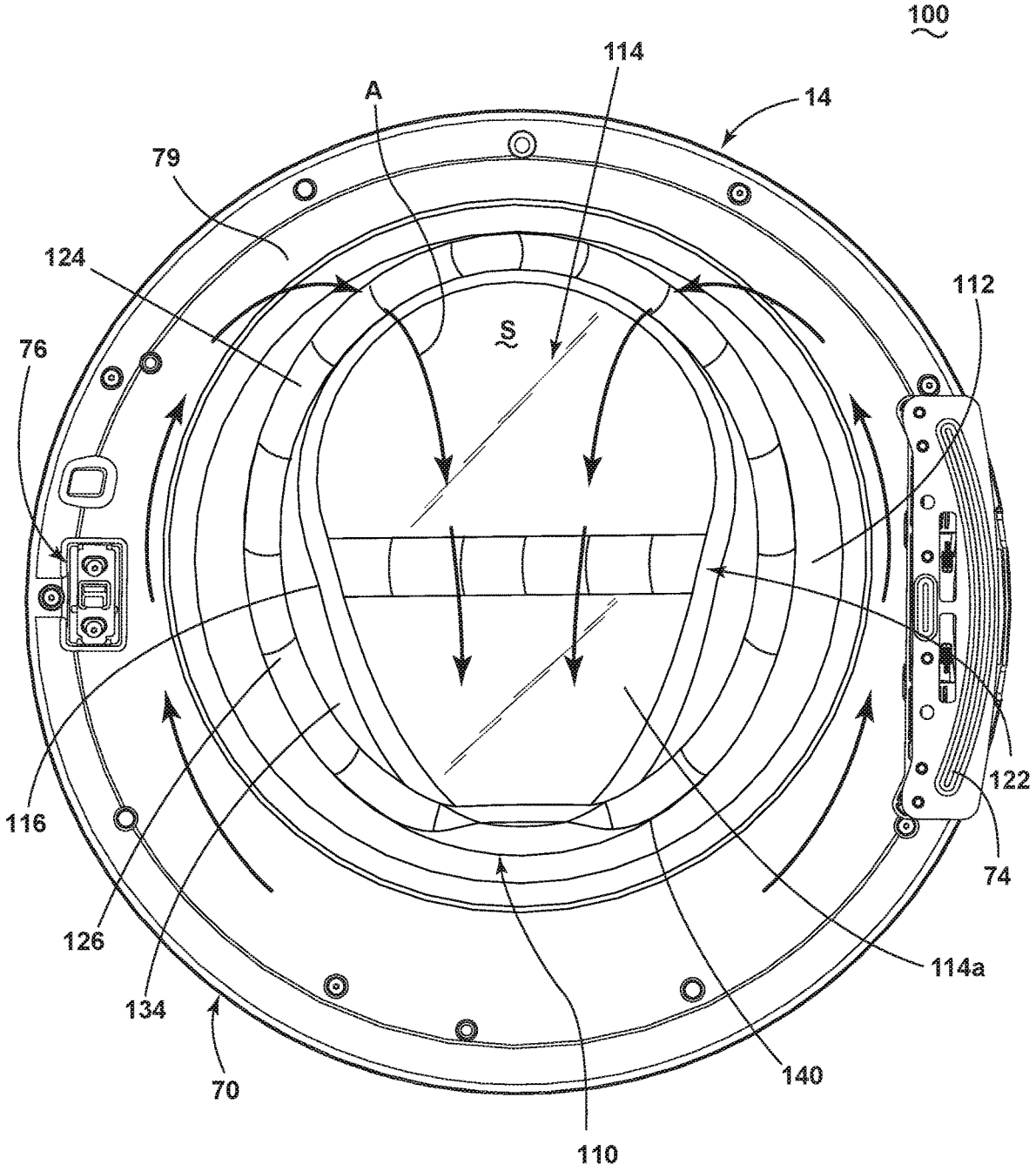
FIG. 5 is a rear elevation view of the door in FIG. 1 illustrating fluid flow paths along the door and adjoining fishbowl.

Laundry items may move along a path defined by the fishbowl 110 and the varying depth of the annulus 116. As the drum 18 rotates during a cycle of operation, laundry items in the treating chamber 20 may travel upward generally circumferentially along the outer wall of the drum 18 on the lifters 22 until, at some point of rotation, the laundry items may move from the lifters 22 to the bottom of the drum 18 in a repeated tumbling action. As illustrated by the arrows labeled "A" in FIG. 5, a portion of the laundry load, and to some extent the treating liquid, may move upwardly along the annulus 116, i.e. the peripheral wall 112, to the upper portion 124 of peripheral wall 112 having the shallowest depth. As the laundry items slide away from the lifters 22, a portion may cross over the upper portion 124 to the inner wall 114 to fall along the downwardly sloping section 114*a* and the lower portion 126 of the peripheral wall 112. The downwardly sloping section 114*a*, as a result of its downward slope, may direct the laundry items into the treating chamber 20. As this occurs, laundry items may be inhibited from contact with the bellows 42, and possible entry into a channel or space between the cabinet 12 and the bellows 42. It is contemplated that a vent is positioned on the upper portion of the fishbowl 110. If the inner wall 114 spans only part of the interior, an opening or vent can be formed in the fishbowl between the inner wall and the annulus.

Turning to FIGS. 6, 7, 8, and 9, similar alternative embodiments of a fishbowl for a door according to the present disclosure are illustrated with like parts identified by like numerals increasing by 100, with it being understood that the description of the like parts of the first embodiment applies to the additional embodiment, unless otherwise noted.

Figure 6:
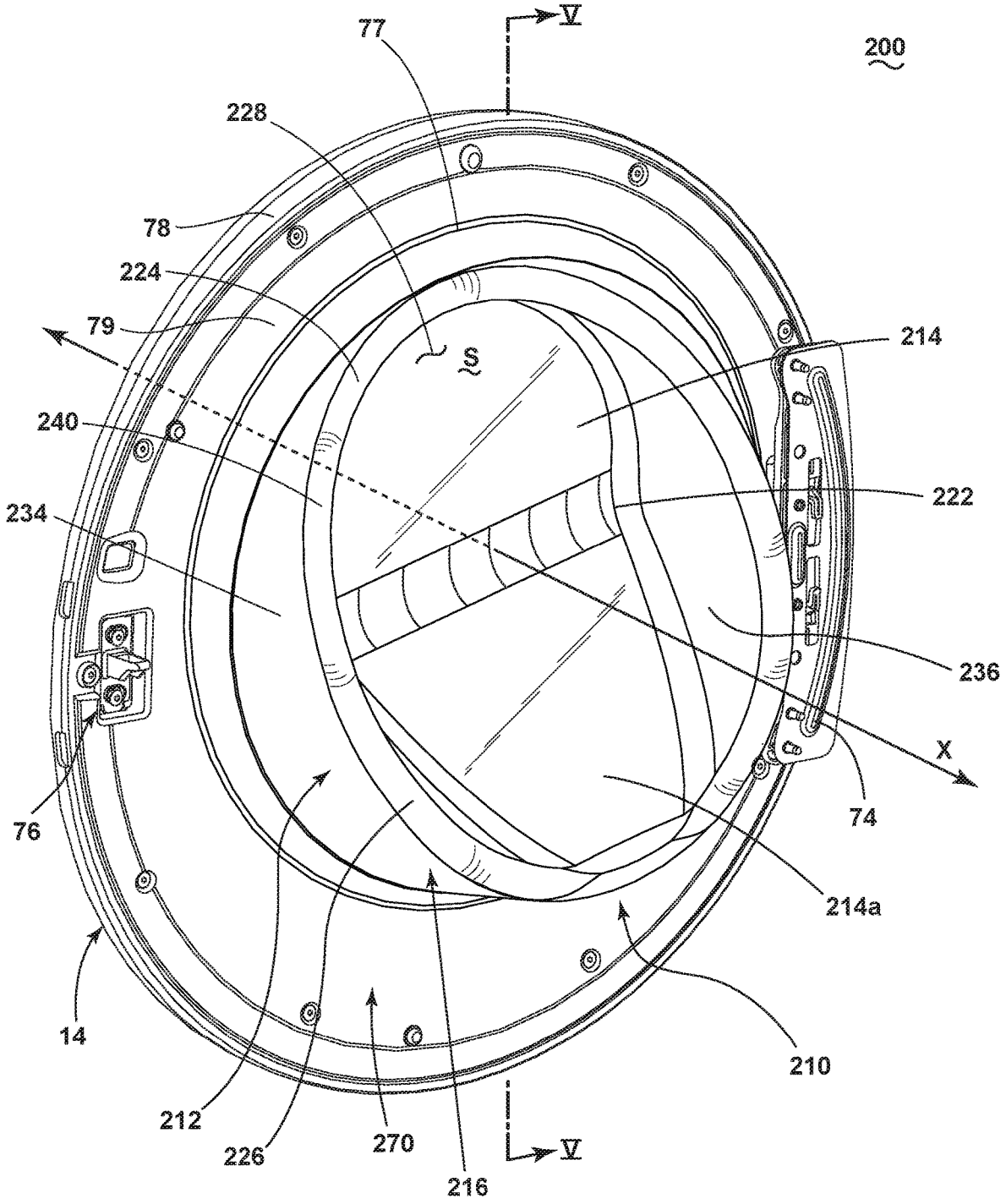
FIG. 6 is a rear perspective view of a door according to another embodiment.

FIG. 6 illustrates a rear perspective view of a door 200 according to another embodiment wherein the intersection 222 of the inner wall 214 and the peripheral wall 212 of fishbowl 210 is spaced further from the upper portion 224 of the annulus 216 and closer to the lower portion 226 than intersection 122 on fishbowl 110.

Figure 7:
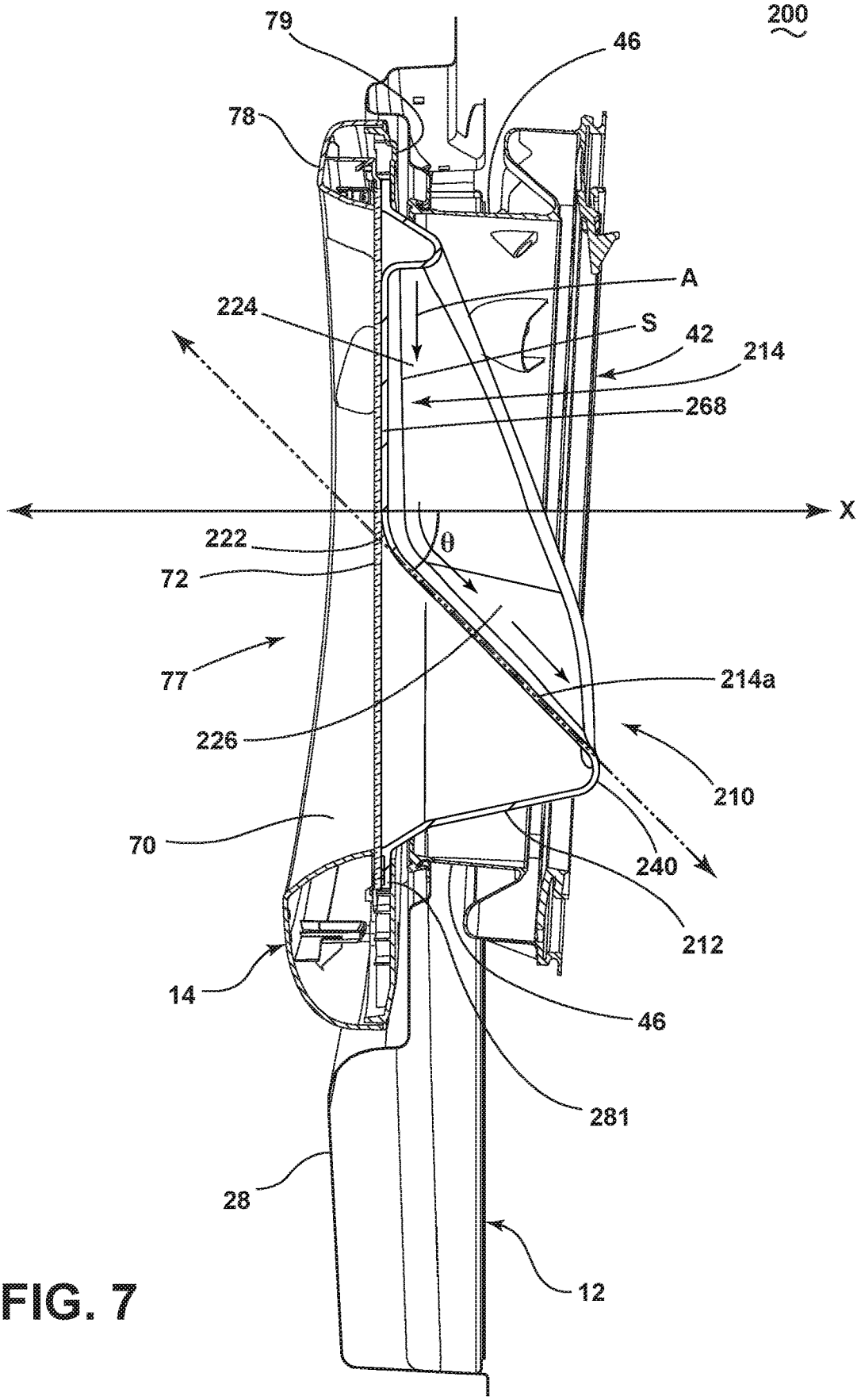
FIG. 7 is a cross-sectional view taken along view line V-V of FIG. 6.

As can be seen more clearly in FIG. 7, the included angle θ defined by the intersection 222 of the inner wall 214 and the peripheral wall 212 relative to the central axis X is about 43°.

Figure 8:
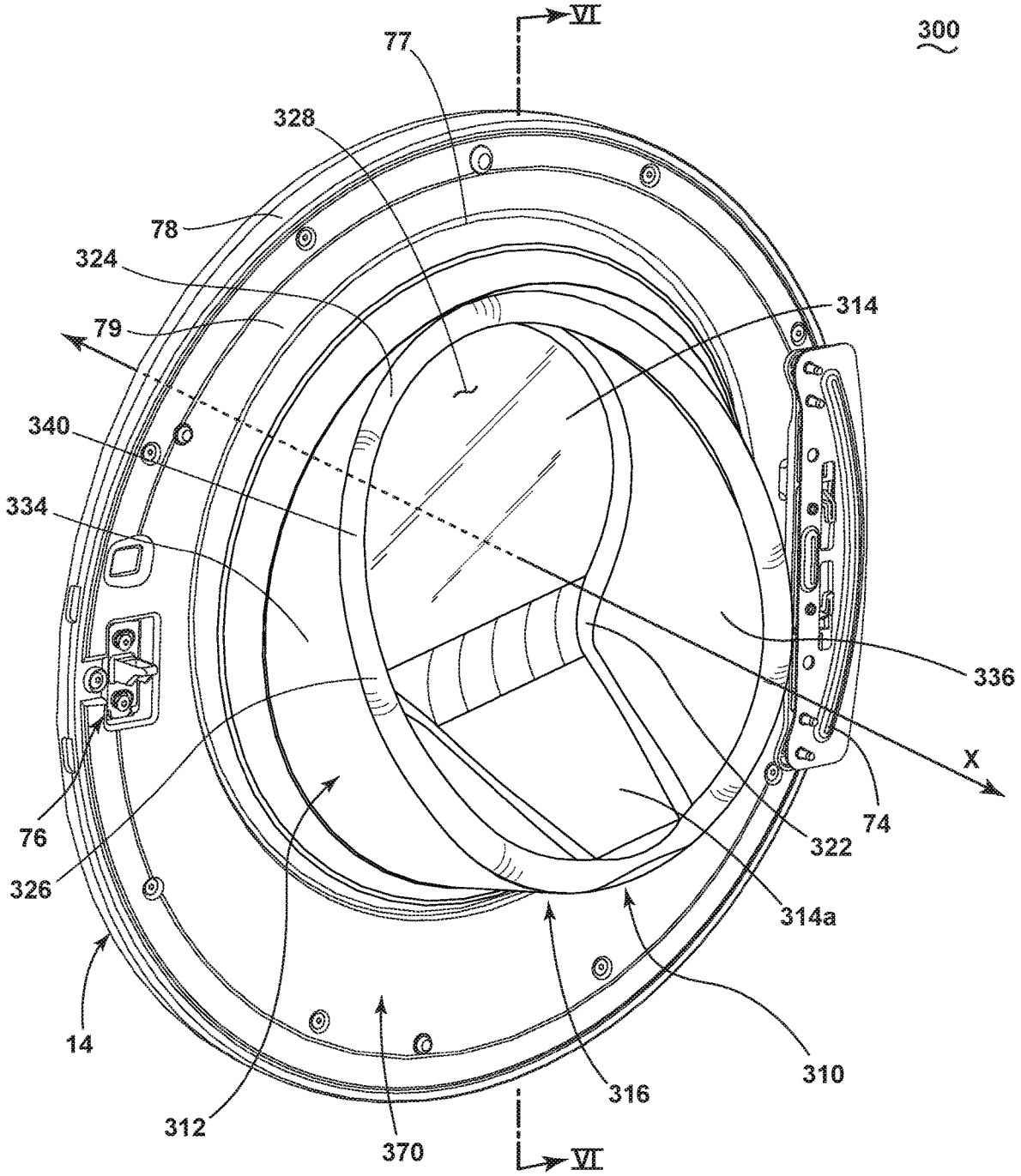
FIG. 8 is a rear perspective view of a door according to another embodiment.

FIG. 8 illustrates a rear perspective view of a door 300 according to another embodiment wherein the intersection 322 of the inner wall 314 and the peripheral wall 312 of fishbowl 310 is spaced further from the upper portion 324 of the annulus 316 and closer to the lower portion 126 than intersection 222 on fishbowl 210.

Figure 9:
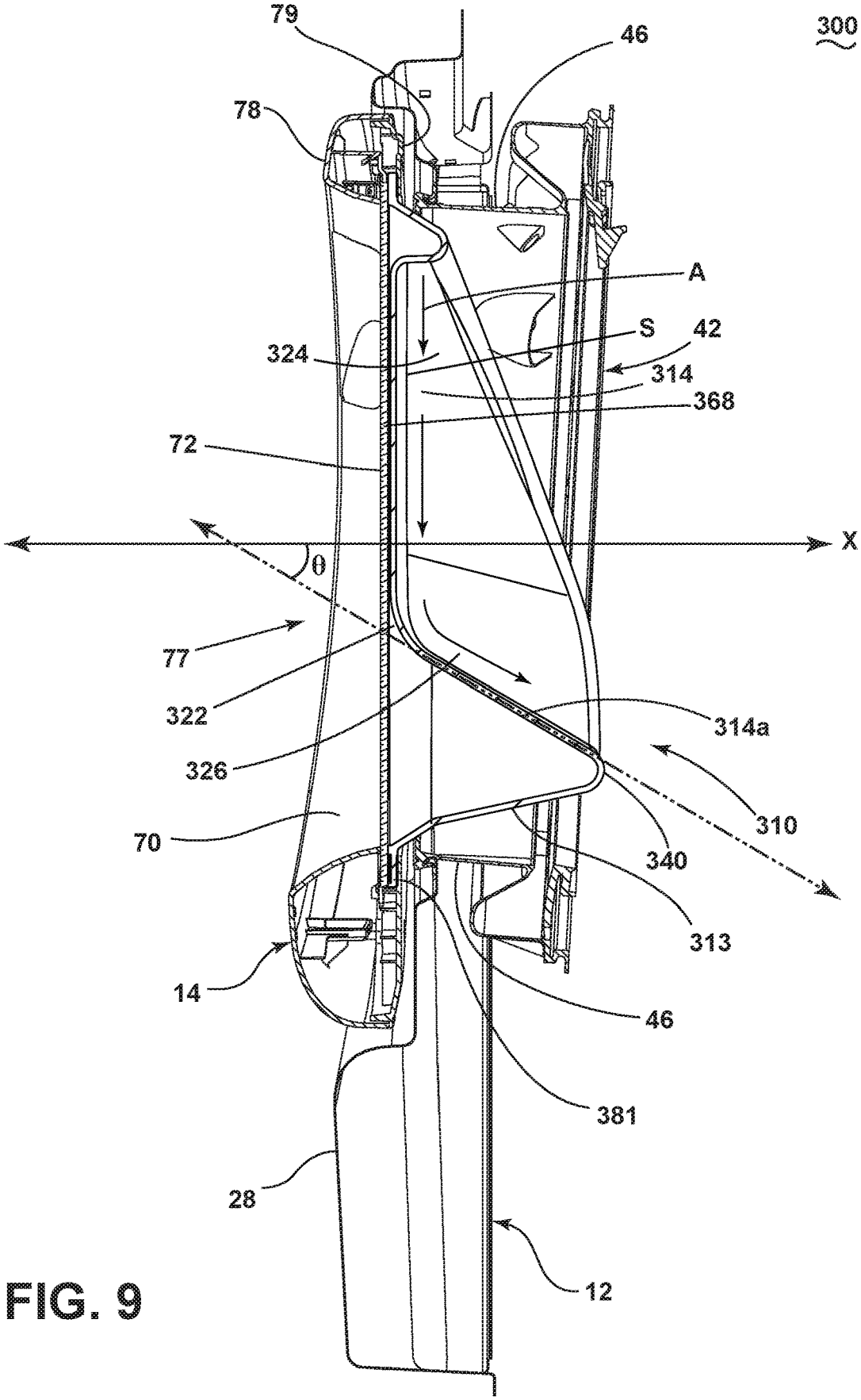
FIG. 9 is a cross-sectional view taken along view line VI-VI of FIG. 8.

As can be seen more clearly in FIG. 9, the included angle θ defined by the intersection 322 of the inner wall 314 and the peripheral wall 312 relative to the central axis X is about 30°. Since Fishbowl 310 has the sharpest included angle θ, it has the highest capacity of the example embodiments.

While the invention has been specifically described in connection with certain specific embodiments thereof, it is to be understood that this is by way of illustration and not of limitation, and the scope of the appended claims should be construed as broadly as the prior art will permit. It should also be noted that all elements of all of the claims may be combined with each other in any possible combination, even if the combinations have not been expressly claimed.

What is claimed is:

1. A fishbowl for a door assembly of a laundry treating appliance, the fishbowl comprising:

a peripheral wall defining an annulus with a central axis, wherein the peripheral wall has a dual-wall structure comprising first and second walls, and the first and second walls intersect to define a junction forming an apex of the peripheral wall; and an inner wall located within the peripheral wall to close the annulus, and defining a surface that intersects with the peripheral wall, with the surface having a vertical portion and an angled portion.

2. The fishbowl of claim 1 wherein the at least one of the vertical portion or the angled portion is planar.

3. The fishbowl of claim 1 wherein the angled portion of the inner wall defines an included angle relative to the central axis that is greater than 30 degrees.

4. The fishbowl of claim 1 wherein the fishbowl is plastic.

5. The fishbowl of claim 1 wherein the intersection of the peripheral wall and the inner wall define a radius having a radius of curvature of less than 200 nm.

6. The fishbowl of claim 1 wherein the fishbowl is at least one of transparent or translucent.

7. A door assembly for a laundry treating appliance comprising:

a frame defining an opening;

a window closing the opening; and a plastic fishbowl adjacent the window and comprising:

a peripheral wall defining an annulus with a central axis, wherein the peripheral wall has a dual-wall structure comprising first and second walls, and the first and second walls intersect to define a junction forming an apex of the peripheral wall; and an inner wall located within the peripheral wall to close the annulus and defining a surface that intersects with the peripheral wall, with the surface having a vertical portion and an angled portion.

8. The door assembly of claim 7 wherein the at least one of the vertical portion or the angled portion is planar.

9. The door assembly of claim 8 wherein the angled portion of the inner wall defines an included angle relative to the central axis that is greater than 30 degrees.

10. The door assembly of claim 7 wherein the intersection of the peripheral wall and the inner wall define a radius having a radius of curvature of less than 200 nm.

11. The door assembly of claim 7 wherein the entire plastic fishbowl is at least one of transparent or translucent.

12. A door assembly for a laundry treating appliance comprising:

a frame defining an opening; and a plastic fishbowl closing the opening and comprising:

a peripheral wall defining an annulus with a central axis wherein the peripheral wall has a dual-wall structure comprising first and second walls, and the first and second walls intersect to define a junction forming an apex of the peripheral wall, and an inner wall located within the peripheral wall to close the annulus and defining a surface that intersects with the peripheral wall, with the surface having a vertical portion and an angled portion.

13. The door assembly of claim 12 wherein the at least one of the vertical portion or the angled portion is planar.

14. The door assembly of claim 12 wherein the intersection of the peripheral wall and the inner wall define a radius having a radius of curvature of less than 200 nm.

15. The door assembly of claim 14 wherein the angled portion of the inner wall defines an included angle relative to the central axis that is greater than 30 degrees.

16. The door assembly of claim 12 wherein the entire plastic fishbowl is at least one of transparent or translucent.

* * * * *